United States Patent [19]

Lamontagne

[11] Patent Number: 4,495,736

[45] Date of Patent: Jan. 29, 1985

[54] AUTOMOBILE SHELTER

[76] Inventor: André Lamontagne, 1083A, boul. Saint-Joseph, Charlesbourg West, Quebec, Canada, G2K 1G3

[21] Appl. No.: 469,156

[22] Filed: Feb. 24, 1983

[51] Int. Cl.[3] ..... E04B 1/34

[52] U.S. Cl. ..... 52/63; 52/174; 123/142.5 R

[58] Field of Search ..... 52/63, DIG. 14, 174, 52/173 DS, 79.5, 173 R; 237/28; 123/147.5 R

[56] References Cited

U.S. PATENT DOCUMENTS

| | | | |
|---|---|---|---|
| 1,234,049 | 7/1917 | Lovell | 123/142.5 R X |
| 1,298,517 | 3/1919 | Koch | 123/142.5 R |
| 1,322,036 | 11/1919 | Martin | 123/142.5 R X |
| 1,481,447 | 1/1924 | Weston | 123/142.5 R X |
| 2,282,324 | 5/1942 | Everitt | 52/174 X |
| 2,417,636 | 3/1947 | Ditzler | 126/110 R |
| 4,228,622 | 10/1980 | Tisma | 52/63 X |

*Primary Examiner*—Carl D. Friedman

[57] ABSTRACT

An automobile shelter is described, intended to house the front engine compartment of the automobile. This shelter is closed by a flexible canvas which surrounds said engine compartment at the rear portion of the latter. Warm air is blown under the oil crank-case, so as to warm not only the crank-case, but also the battery and other various parts situated in the engine compartment. This blown air may be allowed inside the passenger compartment through the automobile ventilating ducts. The shelter may easily be dismantled when not in use. This shelter is useful in warming a car engine and other relevant parts contributing to effectively start the engine, even in very cold weather.

2 Claims, 4 Drawing Figures

AUTOMOBILE SHELTER

FIELD OF THE INVENTION

This invention relates to a fast-starting system for a vehicle engine during cold weather.

BACKGROUND OF THE INVENTION

Several means already exist to help for winter starting, for example the commonly-known block-heater, made of an electrically-heating element; a conventional, full size, heated garage; a dismantable garage which shelters against the wind and bad weather, but which does not bring warmth, and takes a large area, as large as the vehicle itself.

During cold weather, unfortunately, the engine must be run for long periods of time after being started before the vehicle becomes fully operational on the road.

Without question, all these means lack effectiveness, leading to huge energy wastes, or costly structures, or the taking of excessive space.

OBJECTS OF THE INVENTION

The prime object of this invention is thus to provide an efficient, winter-starting system for automobiles, obviating the previously-cited disadvantages.

SUMMARY OF THE INVENTION

The shelter of the invention is of such dimensions that it can house the front engine compartment of an automobile vehicle. This shelter is fitted with a flexible canvas, which closes the shelter opening, and completely surrounds the front section of the car near the windshield area. The shelter is provided with a heating source and, preferably, a warm-air source blown with an air duct connected to this source and opening under the engine compartment of the car.

The shelter is preferably made of heat-insulating materials and, given its smaller dimensions relative to a conventional garage, allows some savings in heating bills. Furthermore, the blown warm air permits not only to warm the crank-case of the engine, but also all the vital parts of that engine, including the battery, the transmission and other parts of the car engine system. Hence, an easy starting is possible, even in the coldest weather, with only a minimal time of engine running.

The blown warm air may also be used to warm up the passenger compartment of the car by simply opening the ventilating ducts of said car. The shelter according to this invention eliminates the need for running the car engine during excessively cold temperatures before operation. Contrary to the engine block-heater, it permits not only to warm up the engine block itself, but also the battery, the transmission and other related parts.

The shelter according to this invention is preferably constructed to be easily dismantled in order to take a minimum of space when not in use.

Cited objects and advantages of the present invention will become clearer when referring to the description which follows and to the annexed drawings, wherein.

In the annexed drawings, same reference numerals indicate same elements throughout.

DETAILED DESCRIPTION OF THE DRAWINGS

Figure 1:
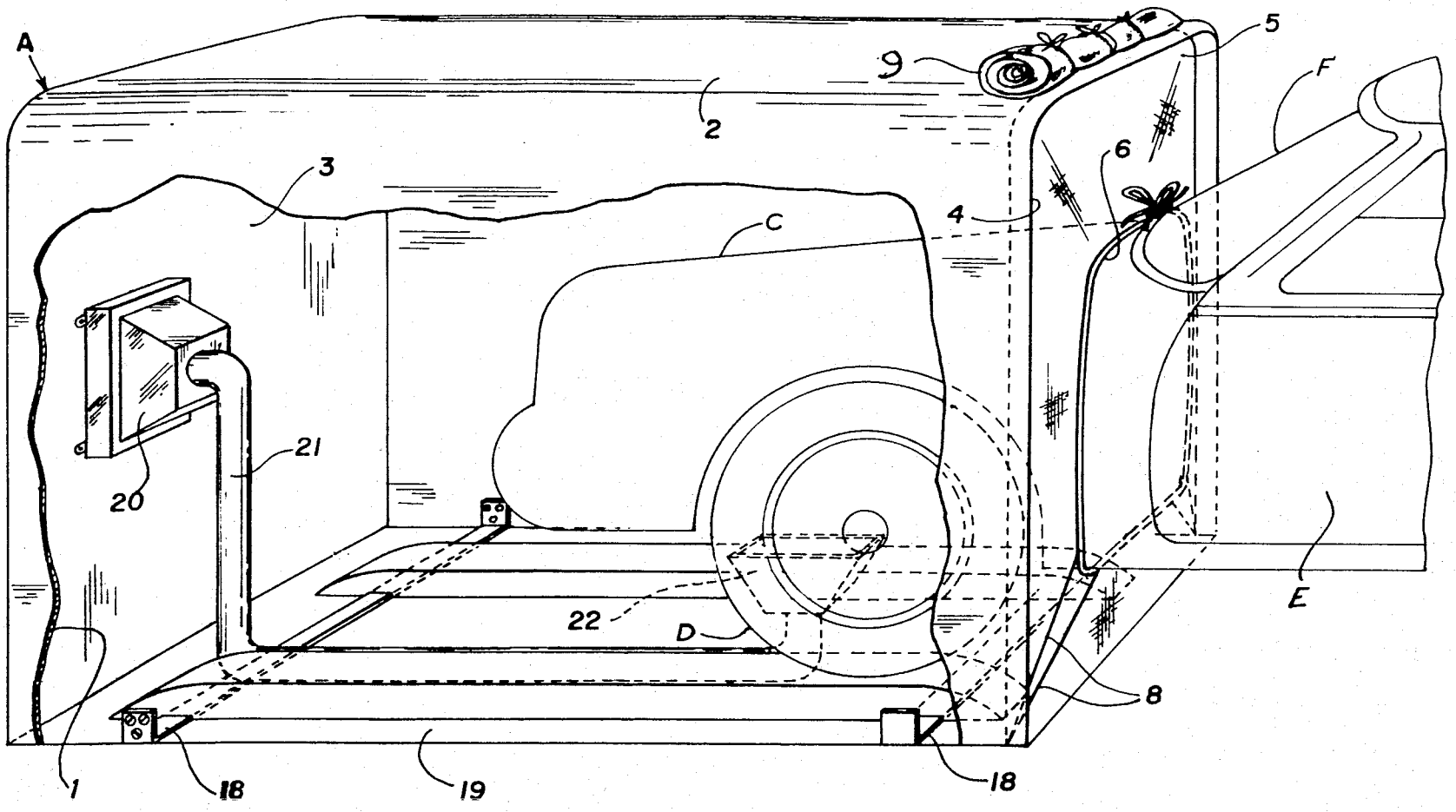
FIG. 1 is a perspective view showing the shelter according to the invention, and the engine compartment of an automobile vehicle housed in this shelter.

The shelter a according to this invention includes two lateral walls 1, a roof 2 and a rear wall 3. The shelter is open in front, creating an opening 4, which is full size. Shelter A is of such given diemensions in height, width and depth that it can house the engine compartment C of an automobile vehicle, which includes the front wheels D of the same.

A flexible membrane 5 is fixed around opening 4 and defines a central aperture 6 which completely surrounds the engine compartment C where it joins with the passenger compartment E of the car, near windshield F. Membrane 5 is supplied with an elastic string 7, all around aperture 6. Hooks 7' are secured to the ends of string 7 and allow, by pulling strings 7, to close aperture 6 about the engine compartment C including the area underneath the car.

Figure 2:
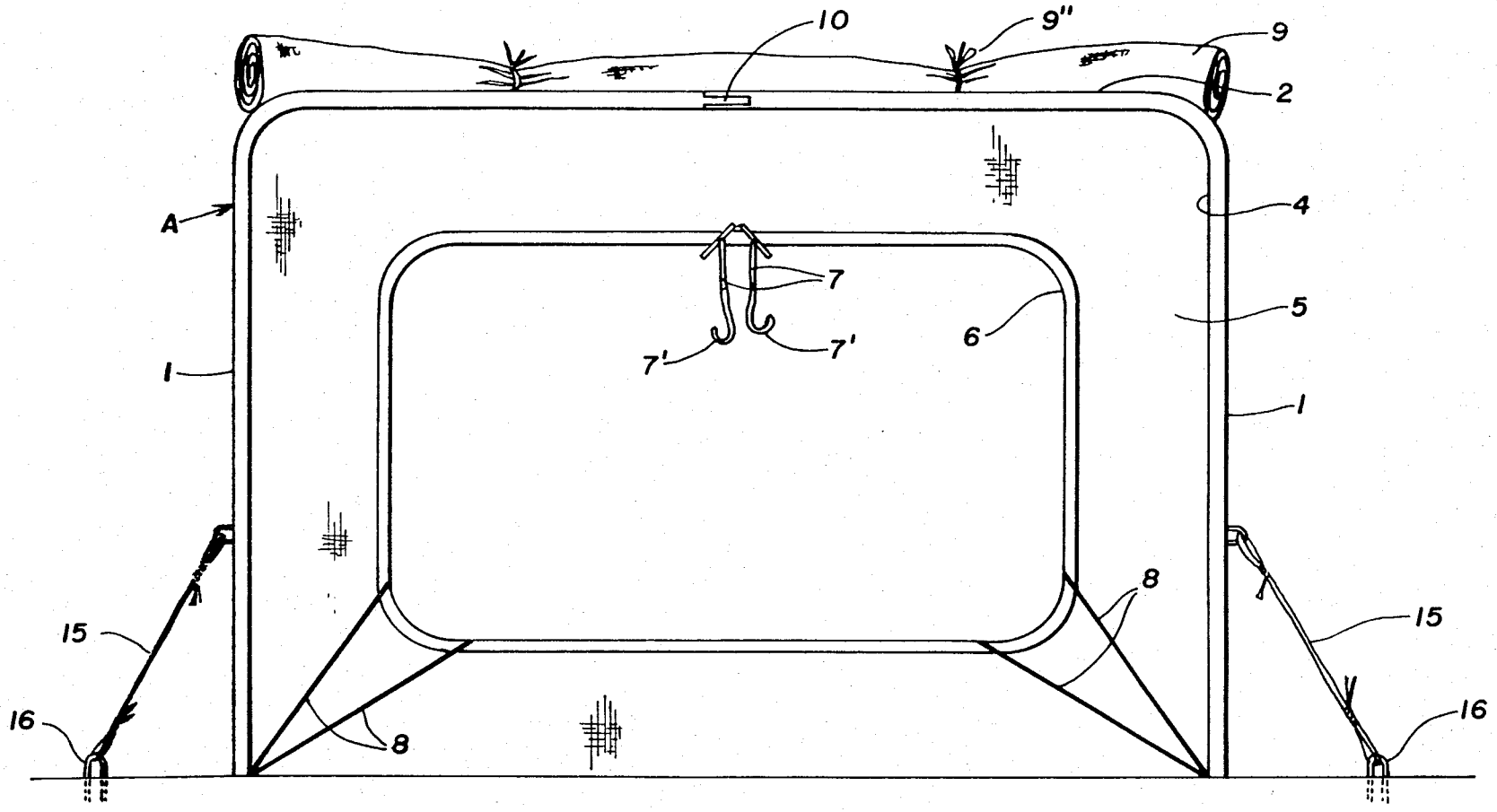
FIG. 2 is an elevation view of the front of the shelter showing its opening.

Resilient bands are tied to the aperture periphery and to the front lower corners of the lateral walls 1, as shown in FIG. 2. When string 7 is released, these bands 8 draw membrane 5 to the ground, in order to allow wheels D of the car to roll over the membrane when the car engages in shelter A or leaves it. When the car is out of the shelter, aperture 6 of the membrane is closed against bad weather by a closure sheet 9 fixed to the front of roof 2; sheet 9 unrolls exteriorly relative to the membrane 5, toward the ground, and will be fixed to the periphery of opening 4 by snap-fasteners 9'. This sheet 9 is rolled and tied to the roof 2 by ropes 9'' to allow the car to engage in the shelter.

Preferably, shelter A is constituted of rigid panels forming lateral walls 1, roof 2 and rear wall 3. These rigid panels are preferably thermally insulated. The shelter is held to the ground by cables 15 stretched by pegs 16.

Preferably, a first lateral wall 1 and a half-section of roof 2, constituting a first, rigid structure, and a second lateral wall 1 and the other half-section of roof 2, constituting a second, rigid structure, join in the center of the roof by a tongue-and-groove joint, as indicated by reference numeral 10.

Figure 3:
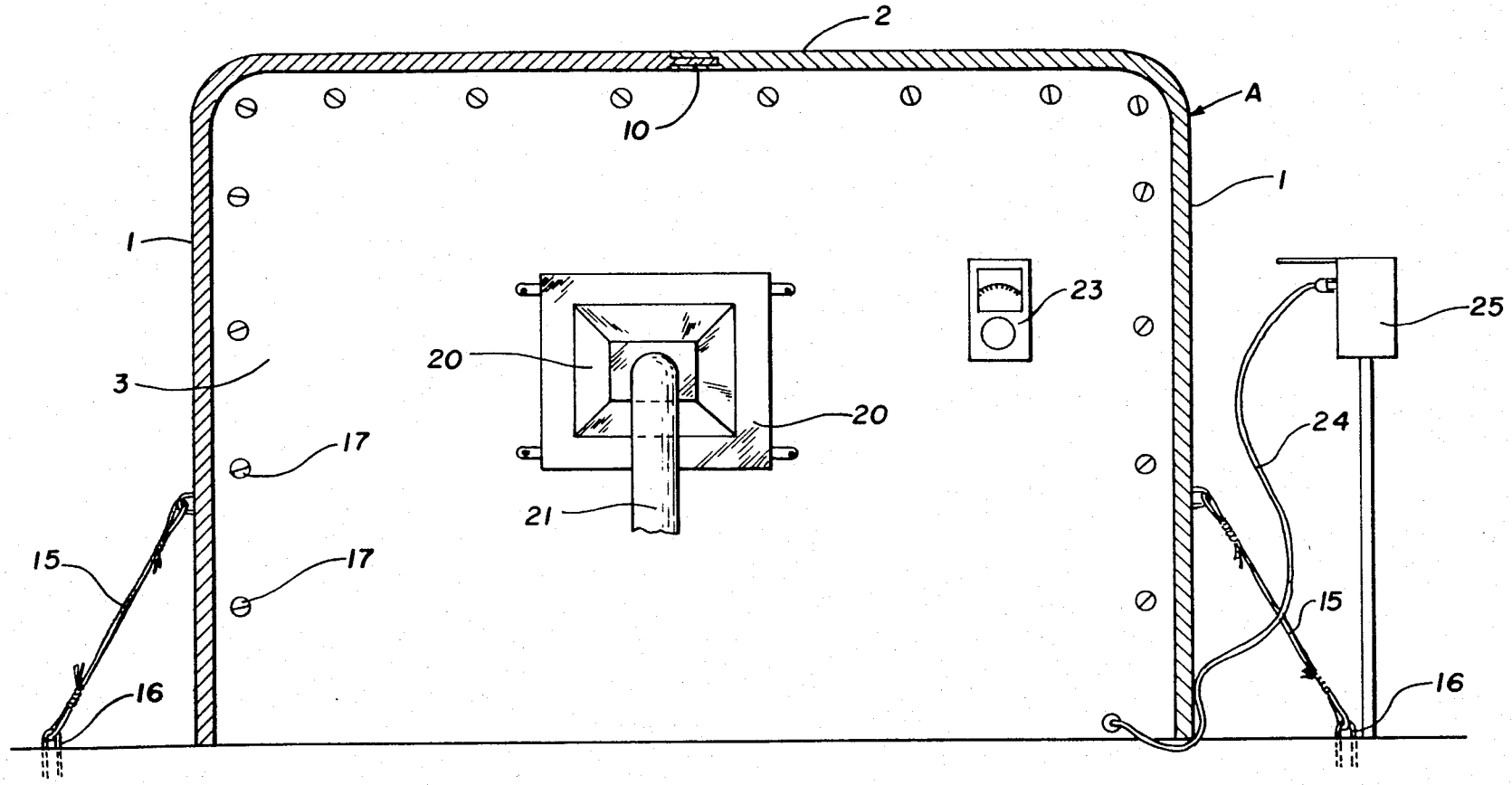
FIG. 3 is a vertical section at the rear of the shelter.
Figure 4:
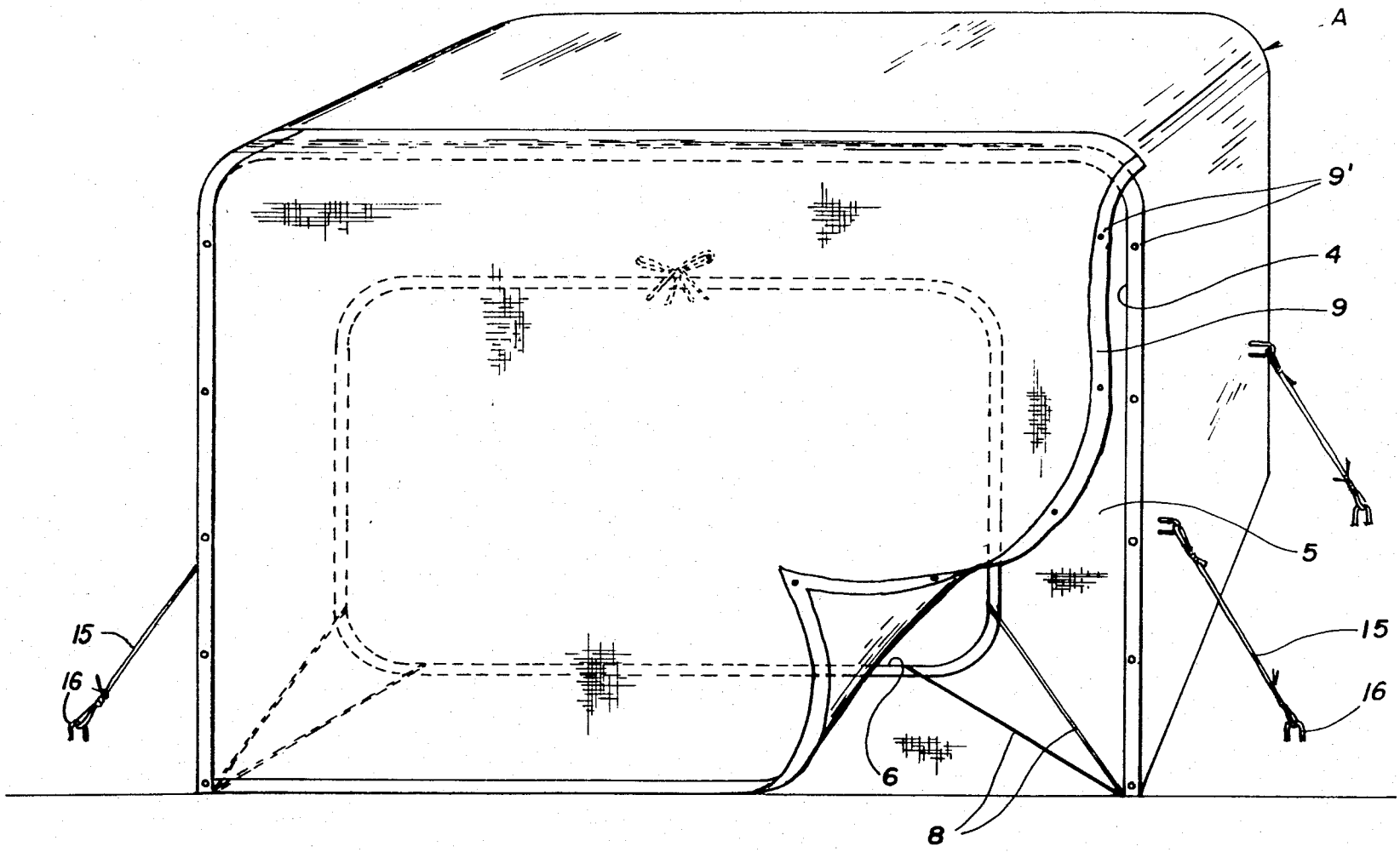
FIG. 4 is a partial, perspective view of the shelter looking at its front opening, which is nearly completely closed.

Rear wall 3 consists of a panel, as shown in FIG. 3, screwed by bolts 17 to the two previously-mentioned structures, consolidating the latter. The lower edges of the latera walls 1 are joined together by transverse braces 18, as shown in FIG. 1. These braces 18 rest on the ground and support running boards 19, which parallel themselves, and are longitudinally arranged relative to the shelter, and separated one from the other by a distance equal to the spacing between the front wheels D of the car, in order to raise these wheels off the ground.

Shelter 1 is provided with a heating source. Preferably, this heating source consists of a conventional, warm air blower 20 comprising a casing, provided with a fan and an electrically-heating element in relation to the fan. The casing is fixed to the rear wall 3 of shelter A inside the latter. The blower 20 sucks up air inside the shelter, heats it and forwards it through an air duct 21 which runs longitudinally of the shelter between the two running boards 19, to open up in a mouth 22 positioned under the oil crank-case of the car engine when the latter is engaged in the shelter. Warm air blower 20 is controlled by a thermostat 23, mounted on rear wall 3, as shown in FIG. 3. Cord 24, coming from switch-actuated electric outlet 25, electrically feeds blower 20.

It can be readily seen that the warm air coming from mouth 22 will not only warm up the engine crank-case and its block, but also the other parts which surround the engine in compartment 8, including the battery, transmission, starter and other conventional parts. The generated flow of warm air is sufficient to warm up at the same time the passenger compartment E of the car, simply by the opening of the car ventilating ducts, commonly located on the dashboard.

Hooks 7' may be fixed in any appropriate place to maintain strig 7 firmly secured around the car.

What I claim is:

1. A shelter for automobiles having an engine compartment and a passenger compartment, said shelter of sufficient height, width and depth to house said engine compartment with the front wheels of the automobile, said shelter including two lateral walls, a rear wall, a roof, said roof including two sections joined one to the other along the longitudinal axis of said roof, each section being integral with one of said lateral walls, said rear wall consisting of a panel fixed to the rear edge of the two half-sections in a dismantable manner, braces detachably connected to the lower edge of said lateral walls and transversely extending along the ground, parallel separate running boards longitudinally positioned relative to the shelter to be used as path-ways for said front wheels of the automobile, said lateral walls and roof defining a front shelter opening which allows said engine compartment to engage into said shelter, a membrane for closing said front opening around said engine compartment at the rear portion of the latter, said membrane defining a central aperture, the periphery of which being provided with elastic strings to tighten said membrane around said engine compartment, elastic bands joining the lower corners of said aperture to the lower front edges of said lateral walls, a flexible closure, fixed to the front roof edge, and capable of closing said opening exteriorly of said membrane when said shelter is not used by an automobile, and warming means to warm up the internal spaced defined by said shelter, said warming means including means to discharge an upward flow of warm air located between said running boards and under said engine compartment when the latter is inside said shelter.

2. A shelter for automobiles having an engine compartment and a passenger compartment, said shelter of sufficient height, width and depth to house said engine compartment with the front wheels of the automobile, said shelter including two lateral walls, a rear wall, a roof, said lateral walls and roof defining a front shelter opening which allows the engine compartment and the front wheels of the automobile to engage into said shelter, a membrane for closing said front opening around said engine compartment at the rear portion of the latter, said membrane defining a central aperture, the periphery of which is provided with elastic strings to tighten said membrane around said engine compartment, braces connected to the lower edge of said lateral walls and transversely extending along the ground, parallel separate running boards longitudinally positioned relative to the shelter to be used as path-ways for said front wheels of the automobile, and warming means to warm up the internal spaced defined by said shelter, said warming means including a warm air blower carried by said rear wall and an air duct connected to said blower, extending between said running boards and provided with a warm air mouth opening upwardly relative to the ground and under said engine compartment when the latter is inside said shelter.

* * * * *